US007841279B2

(12) United States Patent
Reynolds et al.

(10) Patent No.: US 7,841,279 B2
(45) Date of Patent: Nov. 30, 2010

(54) DELAYED EXTRACTION AND A FIREARM CARTRIDGE CASE

(76) Inventors: George L. Reynolds, 2966 Knox Hwy. 3, Altona, IL (US) 61414; S. Paul Reynolds, 2966 Knox Hwy. 3, Altona, IL (US) 61414

( * ) Notice: Subject to any disclaimer, the term of this patent is extended or adjusted under 35 U.S.C. 154(b) by 673 days.

(21) Appl. No.: 11/805,801

(22) Filed: May 24, 2007

(65) Prior Publication Data

US 2010/0258023 A1 Oct. 14, 2010

Related U.S. Application Data

(60) Provisional application No. 60/808,087, filed on May 24, 2006.

(51) Int. Cl.
*F42B 5/26* (2006.01)

(52) U.S. Cl. ..... 102/469; 102/470

(58) Field of Classification Search ..... 102/469, 102/470, 200, 202, 204
See application file for complete search history.

(56) References Cited

U.S. PATENT DOCUMENTS

| | | | | |
|---|---|---|---|---|
| 27,933 | A | | 4/1860 | Smith et al. |
| 62,283 | A | | 1/1867 | Millbank |
| 102,675 | A | | 5/1870 | Gatling |
| 121,808 | A | | 12/1871 | Payne |
| 125,640 | A | | 4/1872 | Wesson |
| 172,716 | A | | 1/1876 | Dimock |
| 268,601 | A | | 12/1882 | Bailey |
| 304,926 | A | * | 9/1884 | Gardner ..... 102/470 |
| 400,165 | A | * | 3/1889 | Bayliss ..... 102/470 |
| 592,942 | A | | 11/1897 | Tichenor |
| 692,154 | A | | 1/1902 | Lammadin et al. |
| 740,790 | A | * | 10/1903 | Young et al. ..... 102/470 |
| 905,358 | A | * | 12/1908 | Peters ..... 102/470 |
| 932,562 | A | * | 8/1909 | Muenzenmaier ..... 102/470 |
| 933,030 | A | | 8/1909 | Funk |
| 1,082,975 | A | | 12/1913 | Rylands |
| 1,240,859 | A | * | 9/1917 | Lallman ..... 102/470 |
| 1,345,565 | A | | 7/1920 | Thompson |
| 1,461,013 | A | | 3/1923 | Hodge |
| 1,491,000 | A | | 4/1924 | Brandt et al. |
| 1,541,438 | A | * | 6/1925 | Schauerte ..... 102/469 |
| 2,379,056 | A | | 7/1943 | Alexander |
| 2,388,094 | A | * | 10/1945 | Snell ..... 102/469 |
| 2,522,208 | A | | 9/1950 | Catlin |
| 2,793,455 | A | | 5/1957 | Wignall |
| 2,818,021 | A | * | 12/1957 | Boehm et al. ..... 102/469 |
| 3,050,894 | A | | 8/1962 | Ivy |

(Continued)

FOREIGN PATENT DOCUMENTS

AU 403856 10/1969

(Continued)

*Primary Examiner*—Michelle Clement
(74) *Attorney, Agent, or Firm*—Krieg DeVault LLP

(57) ABSTRACT

A high pressure cartridge case is provided for firearms with blowback operating systems. The cartridge case is provided with a primer support member that supports a primer in a rearward end of a cartridge case. The support member is slideable rearwardly in the cartridge case when the cartridge is fired. The components expand to seal with the cartridge case to prevent the escape of gas around the support member when the propellant is ignited.

20 Claims, 6 Drawing Sheets

U.S. PATENT DOCUMENTS

| | | | | | |
|---|---|---|---|---|---|
| 3,062,146 | A | * | 11/1962 | Williams et al. | 102/202.9 |
| 3,195,463 | A | * | 7/1965 | Foote et al. | 102/204 |
| 3,312,168 | A | * | 4/1967 | Gawlick et al. | 102/200 |
| 3,351,019 | A | * | 11/1967 | Schaadt et al. | 102/470 |
| 3,359,903 | A | | 12/1967 | Sobolewski | |
| 3,477,374 | A | * | 11/1969 | Barr | 102/470 |
| 3,609,904 | A | | 10/1971 | Scanlon | |
| 3,613,584 | A | | 10/1971 | Hendricks | |
| 3,728,967 | A | * | 4/1973 | Hinkle et al. | 102/472 |
| 3,786,761 | A | | 1/1974 | Ciccone et al. | |
| 3,855,900 | A | * | 12/1974 | Barr et al. | 89/159 |
| 3,885,500 | A | * | 5/1975 | Bornand | 102/470 |
| 3,911,821 | A | | 10/1975 | Finot et al. | |
| 4,085,677 | A | | 4/1978 | Marcinkiewicz | |
| 4,132,173 | A | * | 1/1979 | Amuchastegui | 102/470 |
| 4,316,341 | A | | 2/1982 | Landry | |
| 4,353,304 | A | * | 10/1982 | Hubsch et al. | 102/470 |
| 4,424,638 | A | | 1/1984 | Hillberg | |
| 4,464,990 | A | * | 8/1984 | Bendler et al. | 102/204 |
| 4,615,133 | A | | 10/1986 | Center | |
| 4,848,237 | A | | 7/1989 | Zedrosser | |
| 4,862,805 | A | * | 9/1989 | Szabo | 102/444 |
| 4,881,463 | A | * | 11/1989 | Ninio et al. | 102/202.2 |
| 4,955,157 | A | | 9/1990 | Brighton et al. | |
| 5,005,485 | A | * | 4/1991 | Woo et al. | 102/531 |
| 5,157,219 | A | | 10/1992 | Calsson et al. | |
| 5,272,983 | A | * | 12/1993 | Sippel et al. | 102/469 |
| 5,402,729 | A | * | 4/1995 | Richert | 102/439 |
| 5,481,978 | A | * | 1/1996 | Muller et al. | 102/470 |
| 5,490,463 | A | | 2/1996 | Lamberty et al. | |
| 5,493,975 | A | * | 2/1996 | Franzini et al. | 102/531 |
| 5,969,288 | A | * | 10/1999 | Baud | 102/466 |
| 6,367,389 | B1 | | 4/2002 | Westrom et al. | |
| 6,450,099 | B1 | * | 9/2002 | Desgland | 102/431 |
| 6,516,725 | B2 | | 2/2003 | Jackson et al. | |
| 6,543,363 | B2 | * | 4/2003 | Brion | 102/470 |
| 7,165,496 | B2 | | 1/2007 | Reynolds | |
| 7,581,344 | B2 | * | 9/2009 | Reynolds et al. | 42/25 |
| 2002/0189486 | A1 | | 12/2002 | Westrom et al. | |
| 2006/0143966 | A1 | | 7/2006 | Reynolds et al. | |
| 2007/0214992 | A1 | * | 9/2007 | Dittrich | 102/469 |

FOREIGN PATENT DOCUMENTS

| | | | |
|---|---|---|---|
| DE | 44 08 774 | A1 | 3/1994 |
| WO | WO 01/46637 | A2 | 6/2001 |

* cited by examiner

DELAYED EXTRACTION AND A FIREARM CARTRIDGE CASE

CROSS-REFERENCE TO RELATED APPLICATIONS

This application claims the benefit of the filing date of U.S. Provisional Application Ser. No. 60/808,087 filed on May 24, 2006, which is incorporated herein by reference in its entirety. This application is also related to U.S. patent application Ser. No. 11/316,516 filed on Dec. 22, 2005, which is also incorporated herein by reference in its entirety.

BACKGROUND

Since the inception of machineguns in the late 19$^{th}$ century, millions of self powered firearms firing high pressure smokeless powder cartridges have been manufactured. All high pressure small arms weapons, with a few experimental exceptions, have been provided with locking mechanisms of several basic types. Conventional locked operating mechanisms are expensive because they must be manufactured to close tolerances from high strength materials. Conventional locking mechanisms must be robust and capable of closely supporting the cartridges which must also be manufactured to close tolerances. Locked weapons and their cartridges must be manufactured to close tolerances in order to maintain "headspace" within workable limits while subjected to pressures in excess of 50,000 pounds per square inch.

Practically speaking, headspace is the distance between the locked bolt and the base of a cartridge seated fully forward in the chamber of a weapon. If headspace is excessive, then when the cartridge is fired and while the wall of the cartridge case is seized against the chamber wall, the base of the cartridge can move excessively rearward before contacting the locked bolt. In this event, the cartridge case head can be ripped off the body of the cartridge case resulting in a ruptured cartridge case which usually disables the weapon and can cause severe injury to the shooter. If headspace is insufficient, then the cartridge is too long to fit into the chamber resulting in the failure to lock, and often wedging the cartridge tightly within the chamber, also disabling the weapon.

The high cost of providing close dimensional tolerance in weapon mechanism parts involved in locking has come to be taken as a matter of course in the small arms community.

Conventional cartridge cases are provided with extraction rims and grooves for removing unfired cartridges or fired cartridge cases from the weapon chamber. Conventional extraction rims and grooves are necessarily located behind the rear of the barrel in order to permit access of the extractor to the extraction rim and groove. The primer of a conventional cartridge is located in the rear of the cartridge with the base of the primer flush with the base of the cartridge case. This means that the primer is actually located outside of and behind the rear of the chamber. Therefore the cartridge case around the primer pocket provides the sole support for radial firing pressure. This means that the safe weapon operating pressure with conventional cartridge cases is limited by the strength of the cartridge case head rather than by the strength of the weapon itself, regardless of how strong the weapon breech.

Conventional high pressure bottle necked cartridge cases are not suitable for employment with simple blowback operating systems for two main reasons. First, high pressure cartridge cases cannot tolerate rearward movement of their heads while the case walls are seized in the chamber. Also, since the purpose the enlarged base diameter of bottle-necked cartridge cases is to provide large volume, this means the pressure/area for a blowback operated high pressure bottle neck-necked cartridge would be prohibitively large for an acceptable bolt mass.

SUMMARY

The present invention provides a high pressure cartridge case and a high pressure blowback weapon operating system capable of utilizing the invention cartridge case. The invention weapon and cartridge case are capable of routinely and safely operating at much higher (therefore, more thermodynamically efficient) pressure than conventional cartridges and conventional weapons.

In one embodiment the cartridge is provided with a deeper than conventional primer pocket. A slideable primer is supported by a slideable primer supporting sleeve that is seated flush with the rear of the assembled cartridge. The slideable primer can be a conventional off-the-shelf center fire primer. The slideable primer and slideable primer supporting sleeve are retained in the primer pocket by the light press fit which is commonly associated with primer seating in conventional cartridges. This arrangement places the rear of the primer of a chambered cartridge inside of and forward of the rear of the barrel chamber. This means that all the radial firing pressure in the cartridge case is transmitted to the barrel chamber. The barrel chamber is much stronger than the cartridge case alone. Placement and support of the primer inside of and forward of the rear of the barrel chamber permits the cartridge to safely operate at much higher (therefore, thermodynamically more efficient) pressure than is possible with conventional cartridges. In testing of this arrangement, pressures in excess of 200,000 psi have been sustained without damage to the test rifle.

When the weapon is fired, internal pressure elastically expands and seizes the cartridge case wall tightly against the chamber wall. The firing pressure also begins to drive the projectile forward through the bore and to drive the slideable primer, the slideable primer sleeve and the weapon bolt rearward within the primer pocket of the cartridge case while the cartridge case wall is being held stationary within the chamber. The cylindrical surface of the primer pocket and the outside of the of the slideable primer and slideable primer supporting sleeve can be provided with a lubricant, such as molybdenum disulfide, to facilitate the rearward movement of the slideable primer and primer supporting sleeve.

The slideable primer and primer supporting sleeve permit the design of high pressure straight blowback operating systems. The slideable primer supporting sleeve, which is in contact with the bolt, drives the bolt rearward. The slideable primer and primer supporting sleeve permit blowback operation by providing a means to delay beginning of the cartridge case extraction while the primer and primer supporting sleeve are driven rearward by firing pressure. The slideable primer and primer supporting sleeve move rearward relative to the cartridge until pressure within the cartridge case has subsided enough for the cartridge case to elastically contract and release itself from the chamber wall.

Delay of extraction is accomplished by providing a longitudinally moveable, spring loaded extractor which engages the extraction rim of the cartridge. The longitudinally moveable, spring loaded extractor permits the bolt to move rearward, flexing the extractor spring so the extractor remains stationary until pressure in the chamber has dropped sufficiently to permit extraction of the cartridge case. The longitudinally moveable extractor is moveable relative to the weapon bolt, so the longitudinally moveable extractor can remain stationary relative to the cartridge case while the cartridge case is seized under pressure in the weapon chamber.

In another embodiment, the pressure areas of the support sleeve and the inside of the cartridge case can be made equal so that there is no net longitudinal force applied to the cartridge case during firing. This eliminates the need for longitudinally supporting the head of the cartridge case, thus (coupled with the moveable support sleeve) eliminating the need for a locked weapon firing mechanism to longitudinally support the cartridge case body. All the longitudinal force is transmitted to the bolt through the moveable support sleeve.

Cartridges that efficiently convert the chemical energy of propellant into kinetic energy in projectiles are highly desirable from the military weapon point of view: The higher the thermodynamic efficiency of a military small arms cartridge, the greater the fire power that can be provided within a given weight and volume of ammunition. Other things considered, thermodynamic efficiency increases with the increase in pressure-drop across the thermodynamic process. Therefore, high efficiency cartridges operate at high pressures. There is disclosed herein means for effectively sealing against high pressures while permitting the moveable piston of a cartridge to be used to power a delayed-extraction operating mechanism One embodiment includes a support sleeve with a receptacle for receiving and supporting a conventional primer; the primer receptacle being provided with a sealing means. One sealing means for the support sleeve can be in the form of a separate seal that can be made from metal, plastic or a semi-fluid, (such as asphalt, which is the current common practice in small arms ammunition manufacture for sealing against moisture). The other sealing means depends upon the geometry of the front outer face of the support sleeve permitting the front portion of the support sleeve to expand elastically and/or plastically to provide a firm sliding seal between the support sleeve and the body of the cartridge case.

In yet another embodiment, a support sleeve includes a specialized primer specifically designed for small diameter high pressure, high efficiency cartridge cases. The primer arrangement provides its own seal.

There is also disclosed a seal between the support sleeve and cartridge case body that accommodates expansion of the body of the cartridge case while maintaining a gas tight seal between the support sleeve and the cartridge case body.

In some embodiments, in order to achieve zero longitudinal force being applied to the cartridge case while the weapon is being fired, the diameter of the support sleeve is made the same diameter as the inside diameter of the cartridge case, the diameter of the projectile also being the same as the inside diameter of the case and of the outside diameter as the support sleeve.

DETAILED DESCRIPTION OF ILLUSTRATED EMBODIMENTS

Figure 1:
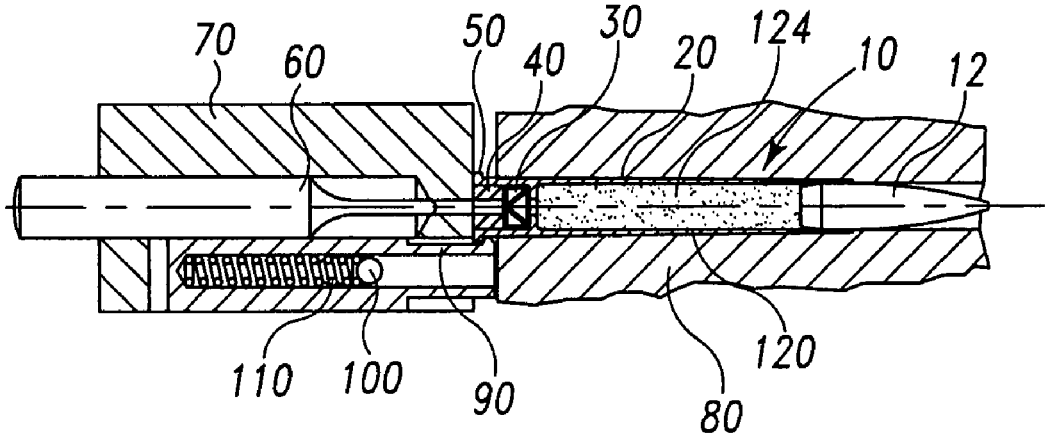
FIG. 1 is a sectional plan view of selected parts of the weapon ready to fire.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any such alterations and further modifications in the illustrated devices, and such further applications of the principles of the invention as illustrated herein are contemplated as would normally occur to one skilled in the art to which the invention relates.

Referring now to FIG. 1 which is a sectional plan view of selected weapon and cartridge parts ready to fire. See also FIGS. 4A and 4B for details of the cartridge 10. Cartridge case 120 of cartridge 10 is seated in chamber wall 20 of barrel 80. Projectile 12 is secured to the forward end of cartridge case 120. Cartridge case 120 includes chamber 122 (FIG. 2) housing a propellant 124. Bolt 70 is seated against the base of cartridge case extraction rim 50 and to the rear of slideable primer supporting sleeve 40. Slideable primer 30 is a conventional center fire primer. Slideable primer 30 in the rear portion of cartridge case 120 is located forward of, and inside, the rear end of barrel 80. Slideable primer 30 and slideable primer supporting sleeve 40 are retained by a light press fit with the base of cartridge case 120. A lubricant, such as molybdenum disulfide, can be placed between slideable primer, slideable primer supporting sleeve and primer pocket 130 (in FIG. 4A) in the rear portion of cartridge case 120. Bolt 70 is not locked but is designed with mass suitable for blowback operation. Longitudinally moveable extractor 90 is engaged with cartridge case extraction rim 50 of cartridge case 120. Longitudinally moveable extractor 90 is being urged rearward by extractor spring 110. Extractor spring 110 and longitudinally moveable extractor 90 are retained in bolt 70 by extractor pin 100. Firing pin 60 is poised behind slideable primer supporting sleeve 40 and slideable primer 30. The hole through slideable primer supporting sleeve 40 is sized to permit passage of firing pin 60.

Figure 2:
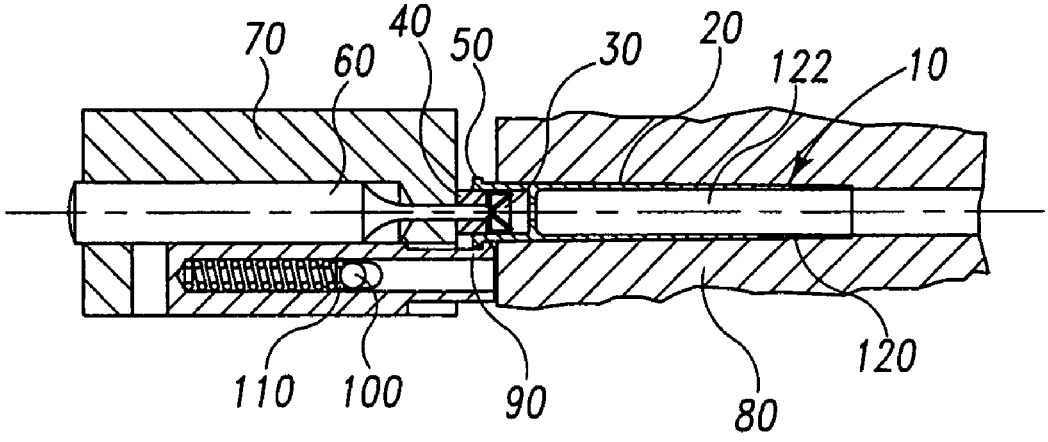
FIG. 2 is a sectional plan view of selected parts of the weapon in the act of firing.

Referring now to FIG. 2, there is shown a sectional plan view of selected parts of the weapon and cartridge in the act of firing. Firing pin 60 has been driven forward and has struck slideable primer 30, initiating slideable primer 30, which has ignited the propellant in cartridge case 120. Expanding gas generated by combustion of the propellant has generated sufficient pressure to elastically expand the wall of cartridge case 120 against chamber wall 20 with such force that the cartridge case wall of cartridge case 120 is seized by static friction with chamber wall 20 of barrel 80. During the time the cartridge case wall of cartridge case 120 is seized in chamber wall 20, the pressure inside cartridge case 120 is driving the projectile forward through the bore of the barrel while bolt 70 is driven rearward by slideable primer supporting sleeve 40 which, in turn, is being driven by slideable primer 30.

The required bolt mass, when employing delayed extraction with the invention cartridge can be less than the mass of conventional gas operated locked weapon operating systems. The 62 grain projectile fired by the 5.56 mm M855 NATO Cartridge in the U.S. M249 Light Machinegun has a muzzle velocity of about 3,050 feet per second. The recoiling parts of the M249 weigh about 1.63 lbs. The gas cylinder assembly weighs a further 0.33 lbs. Therefore the total weight of parts directly involved in powering the M249 is 1.96 lbs. This weight does not include the barrel extension or the extra mass dedicated to structural strength required for weapon to withstand firing shock transmitted through the locking system into the weapon frame. Employment of the invention permits the design of much lighter weapons than weapons employing convention locking systems and conventional ammunition.

Assume, for example, 20 ft/sec as an acceptable operating system recoiling mass velocity for a 5.56 mm light machinegun. Assume a 62 grain projectile fired at 3,050 ft/sec. Then substituting in the equation MV=mv: where M=recoiling (bolt) mass; V=recoiling mass velocity; m=projectile mass; and v=projectile velocity:

$$M(bolt)\times V(20\ ft/sec)=m(0.0088571\ lb)\times v(3{,}050\ ft/sec)$$

$$M(bolt)=1.3508\ lbs.$$

The above also assumes the pressure area of the projectile equals the effective pressure area operating against the bolt. In actual practice, the pressure/area of the primer could be somewhat smaller that the pressure area of the projectile, with the result that the recoiling mass could be even lighter. Calculations, based upon accelerations of the projectile and bolt, reveal that the bolt moves about 0.050 inch while the bore is pressurized. This means that employment of the invention permits the design of lightweight full power blowback operated machineguns which can duplicate the external ballistics of the 5.56 mm NATO cartridge. The invention is not limited as to projectile caliber or weight.

As shown in FIG. 2 longitudinally moveable extractor 90 is engaged with cartridge case extraction rim 50. Bolt 70 is moving rearward while longitudinally moveable extractor remains engaged and stationary with cartridge case extraction rim 50 of cartridge case 120. Cartridge case 120 will remain seized with chamber wall 20 by friction as long as the chamber pressure exceeds the elastic strength of the cartridge case wall of cartridge case 120. At some point, say at 0.050 inch of bolt 70 travel, the chamber pressure will subside sufficiently to permit the wall of cartridge case 120 to move elastically away from chamber wall 20 of barrel 80 permitting extraction of cartridge case 120 by longitudinally moveable cartridge case extractor 90.

Figure 3:
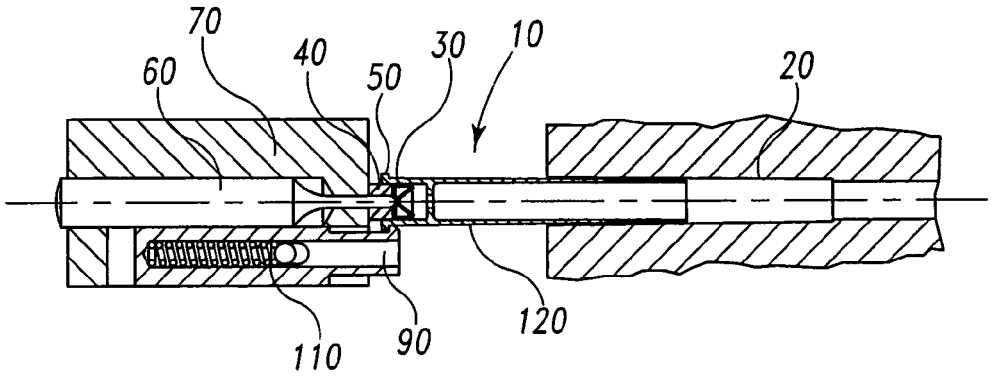
FIG. 3 is a sectional plan view of selected parts of the weapon during extraction.

FIG. 3 is a sectional plan view of selected parts of the weapon during extraction. Longitudinally moveable extractor 90 is still engaged with cartridge case extraction rim 50, thereby extracting cartridge case 120 from the chamber surrounded by chamber wall 20. Firing pin 60 remains engaged with slideable primer supporting sleeve 40 to retain cartridge case extraction rim 50 of cartridge case 120. Extractor spring 110 continues to urge longitudinally moveable extractor rearward against cartridge case extraction rim 50 of cartridge case 120. After bolt 70 has moved sufficiently rearward to permit ejection, firing pin 60 will be withdrawn from primer supporting sleeve 40 to permit cartridge case 120 to be released from longitudinally moveable extractor 90.

Figure 4A:
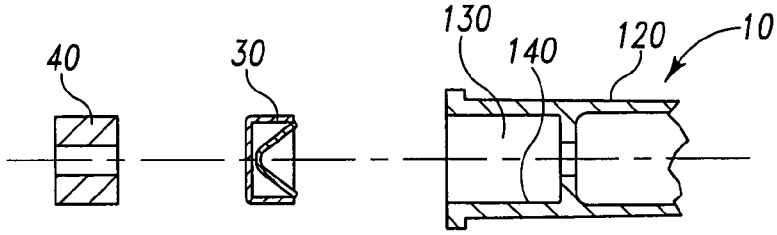
FIGS. 4A and 4B are partial sectional side views and end views of the cartridge case.
Figure 4B:
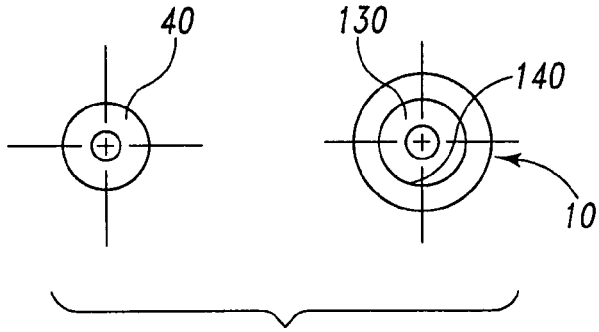

FIGS. 4A and 4B are exploded views of selected parts of the cartridge. Primer supporting sleeve 40 and primer 30 are designed with a light interference fit with primer pocket 130 of cartridge case 120. Surface 140 of primer pocket 130 may be lubricated with a lubricant such as molybdenum disulfide. When the weapon is fired, the pressure within cartridge case 120 becomes sufficiently high to cause all radially loaded inside surfaces of cartridge case 120 to expand against the chamber wall. The pressure inside cartridge case 120 also presses against the inside of slideable primer 30, increasing the friction force between slideable primer 30 and the primer pocket 130. Lubricant place on surface primer pocket surface 140 allows slideable primer 30 and primer supporting sleeve 40 to move rearwardly relative to primer pocket 130 during firing.

Figure 5:
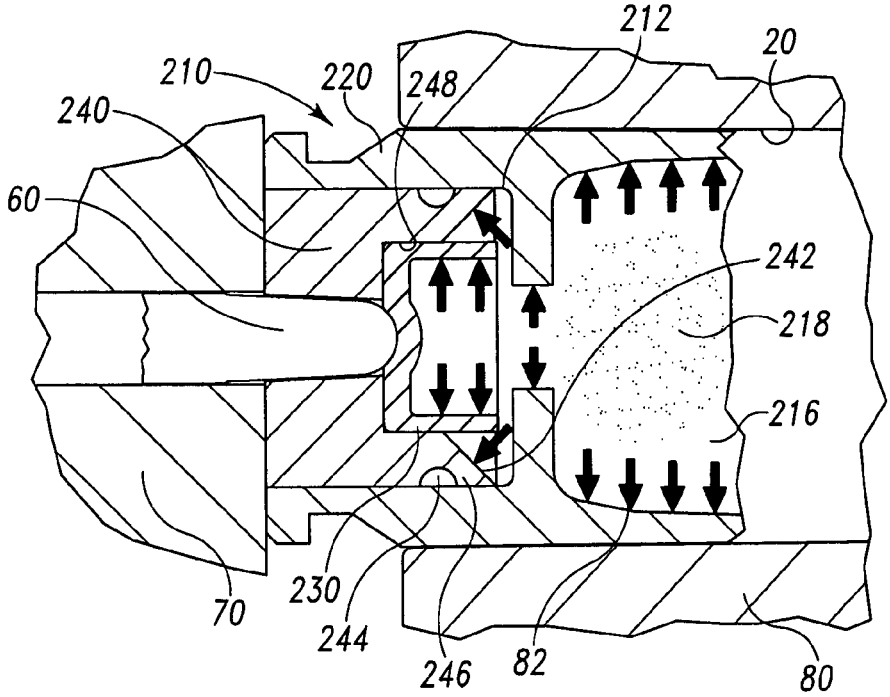
FIG. 5 is a sectional side view of another embodiment shown at the moment of firing.

Referring now to FIG. 5, in which another embodiment cartridge 210 is illustrated. Cartridge 210 is in the act of firing a projectile, like projectile 12 in FIG. 1, with propellant 218 in chamber 216, after having been actuated by firing pin or striker 60 in bolt 70. All the radial pressure exerted by the propellant gases generated within cartridge case 220, as represented by a multiplicity of arrows 82, is transmitted to barrel 80. (The anvil of primer 230 has been omitted from FIG. 5 for clarity in illustrating the effects of radial pressure within primer 230. The longitudinal components of the pressure are also omitted for clarity.) Pressure is also being applied perpendicularly to bevel 242 of piston or support sleeve 240. Bevel 242 forms an angled edge that extends from the forward end of support sleeve 240 at the outer surface of support sleeve 240 to primer pocket 248 of support sleeve 240, which houses primer 230.

The location and sizing of annular recess 244, taking into account the physical characteristics of the material of support sleeve 240, are designed to permit flange 246 of support sleeve 240 to be pressed into firm and gas-tight, but slideable contact between the front of support sleeve 240 and support sleeve recess 212 of cartridge case 220. This slideable gas-tight seal permits support sleeve 240 to be driven rearward by the propellant gas pressure within stationary support sleeve recess 212. The pressure of the propellant gases far exceeds the hoop strength of cartridge case 220, so cartridge case 220 has been radially expanded hard against chamber wall 20 of barrel 80. Barrel 80 possesses adequate strength and rigidity to support cartridge case 220, and to prevent cartridge case 220 from elastically and plastically expanding beyond the ability of cartridge case 220 to contract away from the chamber wall 20 when the propellant gas pressure subsides. As long as the propellant gas pressure remains sufficiently high to press the wall of cartridge case 220 into hard contact with the chamber wall 20 of barrel 80, cartridge case 220 remains seized in the chamber of barrel 80.

Bolt 70 of the weapon may or may not be locked to the weapon frame. If bolt 70 is of a locked type, then support sleeve 240 will remain as illustrated in FIG. 5, throughout the firing, extraction and ejection portions of the cycle of functioning. If bolt 70 is in a weapon that employs a delayed extraction operating system, then the longitudinal component (not shown) of the forces exerted by the propellant gases can drive support sleeve 240 and bolt 70 rearward to operate the weapon mechanism.

Figure 6:
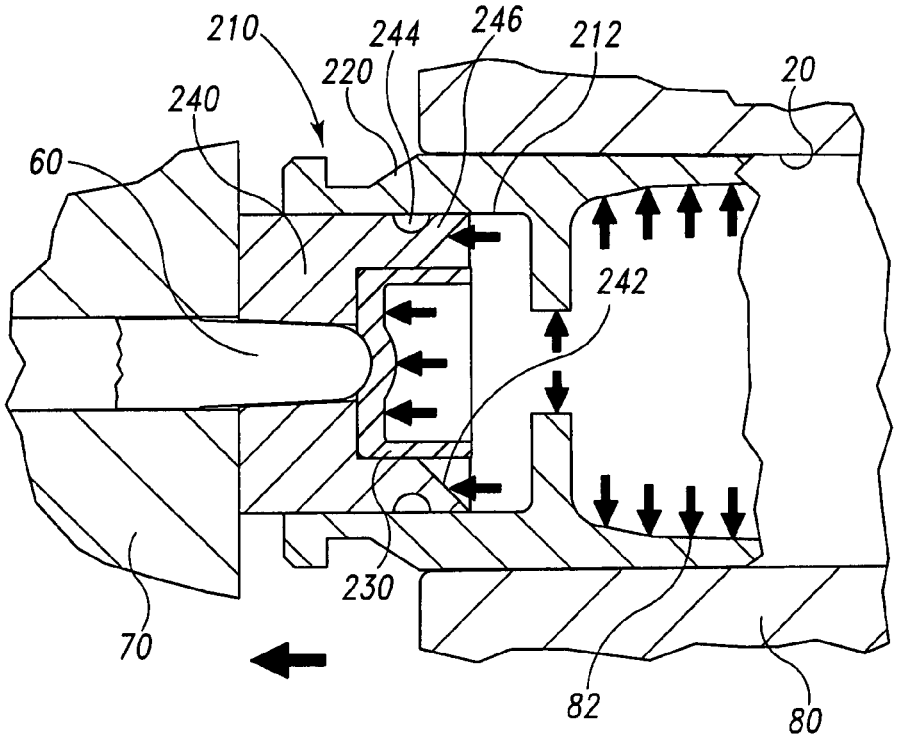
FIG. 6 is a sectional side view of the embodiment of FIG. 5 at the end of the power stroke, but before the beginning of extraction.

Referring now to FIG. 6, support sleeve 240 is shown nearing the end of its power stroke in a delayed-extraction operated mechanism. Gas pressure, illustrated by a multiplicity of small arrows 82, is shown also pressing longitudinally. As long as the radial component of the gas pressure is sufficient to cause cartridge case 220 to remain radially seized against the wall 20 of the chamber in barrel 80, cartridge case 220 remains stationary relative to the barrel. In the meantime, however, the longitudinal component of the chamber pressure continues to drive support sleeve 240 slideably rearward within support sleeve recess 212, with flange 246 being pressed against support sleeve recess 212 forming a gas tight seal. Any small quantities of gas that escape past the seal formed by flange 246 and support sleeve recess 212 are collected in annular recess 244.

Figure 7:
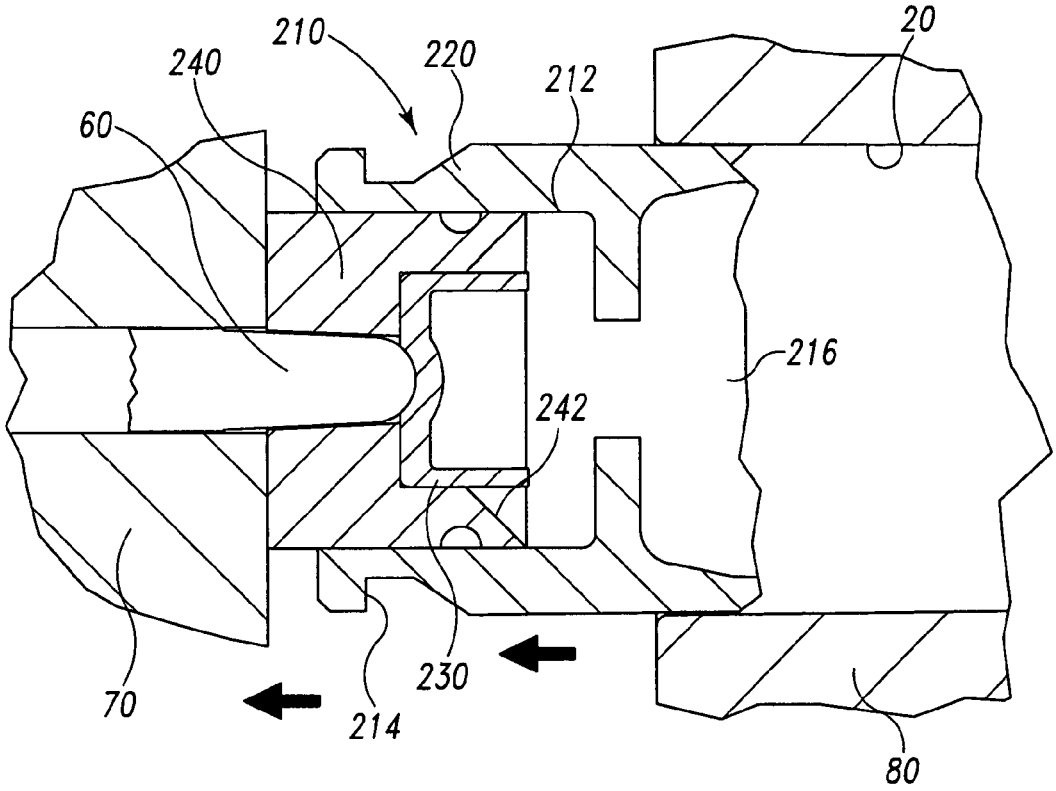
FIG. 7 is a sectional side view of the embodiment of FIG. 5 during extraction of the fired cartridge case.

Referring now to FIG. 7, the gas pressure has subsided completely or at least sufficiently enough for cartridge case 220 to elastically contract radially and so to be released from the chamber of barrel 80. The delayed extractor, such as shown with extractor 90 discussed above, has engaged with extraction rim 214 of cartridge case 220, and cartridge case 220 is being extracted from the chamber.

Figure 8A:
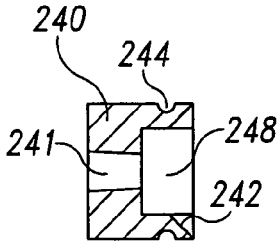
FIGS. 8A, 8B and 8C are exploded sectional side views of the components of the embodiment of FIG. 5.
Figure 8C:
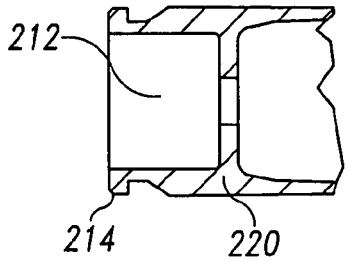
Figure 8B:
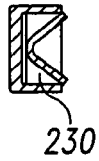

Referring now to FIGS. 8A, 8B and 8C, cartridge case 220, support sleeve 240 and primer 230 as illustrated in separate views of the cartridge case components shown in FIGS. 5, 6 and 7. Annular recess 244 encircles support sleeve 240 in its outer surface. In another embodiment, recess 244 extends around a portion of the outer surface of support sleeve 240. Bevel 242 can encircle the forward end of support sleeve 240, or extend around one or more portions of the forward end. The front or forward end of support sleeve 240 is provided with primer pocket 248 for receiving and supporting primer 230. The rear of support sleeve 240 is provided with a passage 241 to provide access for striker 60 of the weapon. Primer 230 is shown complete with priming composition and an anvil. Primer pocket 248 of support sleeve 240 is designed to provide a light press fit of primer 230 with primer pocket 248. Support sleeve 240 is also designed to have a light press fit with support sleeve recess 212 of cartridge case 220.

In the embodiment discussed above, a cartridge case with a slideable support sleeve 240 is provided. The groove 244 around support sleeve 240 serves to trap some escaping gases, but mostly serves to weaken the front of the support sleeve so forward flange 246 of support sleeve 240 can expand against the cartridge case in rearward recess 212 of the cartridge case 220. The bevel 242 at the forward end of support sleeve 240 includes an angle that can be adjusted to control the pressure angle that will determine the force actuating the seal.

Figure 9:
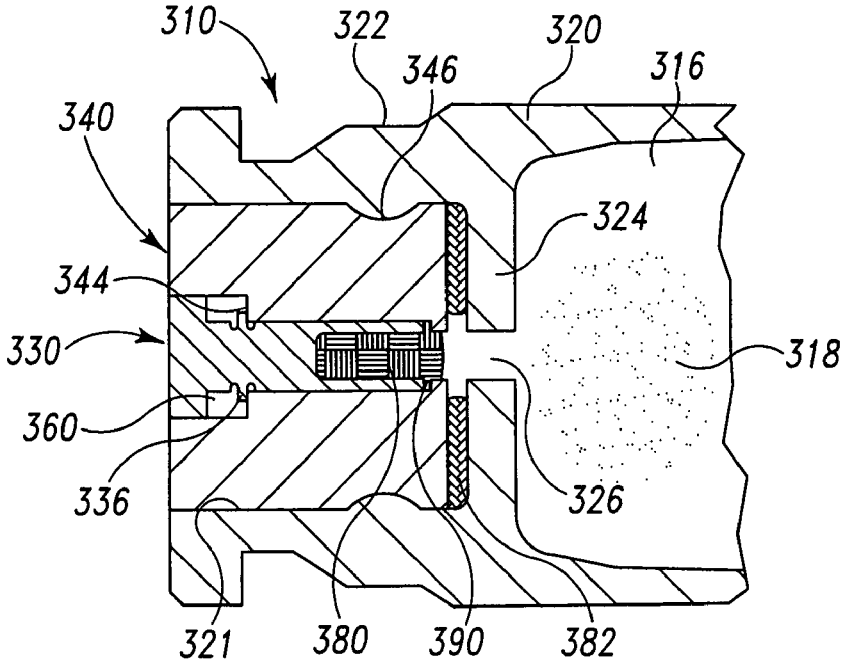
FIG. 9 is a sectional side view of another embodiment.
Figure 10A:
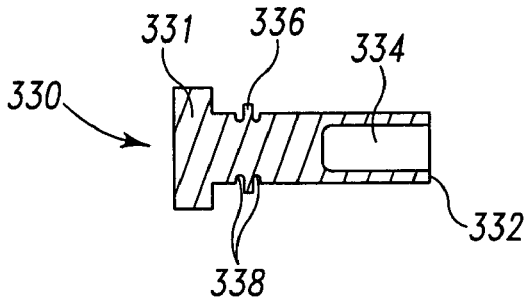
FIGS. 10A and 10B are sectional side views of selected components of the embodiment of FIG. 9.
Figure 10B:
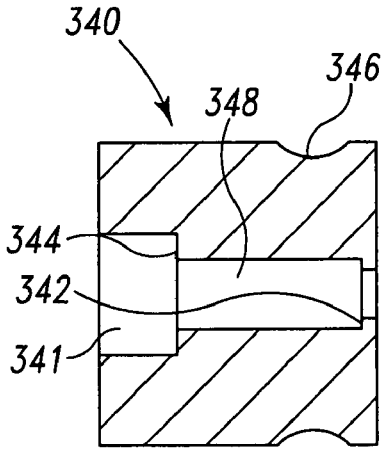

Referring now to FIGS. 9, 10A and 10B, there is illustrated another embodiment cartridge 310. Cartridge 310 includes a projectile (not shown) like projectile 12 at a forward end thereof and a chamber 316 housing propellant 318 in a cartridge case 320. Cartridge case 320 is designed for smaller diameter and/or higher pressure applications than may be practicable with the first embodiment. This tolerance for higher pressure is made possible by combining primer 330 with support sleeve 340. A small portion of primer composition 380 is contained within pinch point 390 that is formed between front face 332 of primer 330 and primer anvil 342 of support sleeve 340.

This embodiment illustrates means for preventing gas leaks, and for compensating for such leakages that may occur. Primer composition 380 is contained in primer cavity 334 of primer 330. Primer 330 is provided with shoulder 336 flanked by grooves 338. Primer 330 is positioned in passage 348 of support sleeve 340 so that shoulder 336 rests against surface 344 in a rearward pocket 341 of support sleeve 340. The purpose of shoulder 336 of primer 330 is to prevent primer 330 from being prematurely driven forward as a result of dropping of the cartridge or other accident. Shoulder 336, flanked by grooves 338, is designed to plastically yield and deform when the weapon striker strikes primer 330. This corresponds to the force required to deform the primer cup of a conventional primer in the process of igniting the primer composition.

Support sleeve 340 can be provided with groove 346 so that when support sleeve 340 is assembled to cartridge case 320 in rearward recess 321 thereof, then cannelure 322 can be pressed onto cartridge case 320 as shown in FIG. 9. Pressing cannelure 322 onto cartridge case 320 causes material of cartridge case 320 to be pressed into groove 346 of support sleeve 340, forming a mechanical interference against escape of propellant gas past support sleeve 340, even in the event of expansion of cartridge case 320 as support sleeve 340 moves rearward within cartridge case 320.

Figure 11:
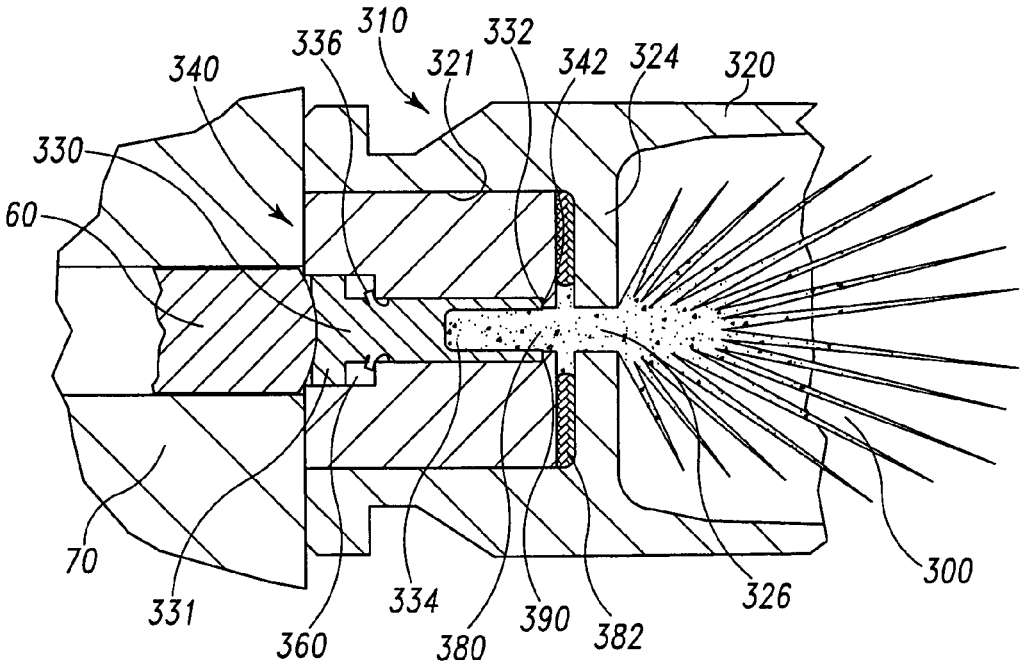
FIG. 11 is a sectional side view of the embodiment of FIG. 9 at the moment of firing.

Referring now to FIG. 11, primer 330 has been driven forward by striker 60 of the weapon. Shoulder 336 of primer 330 has been plastically deformed, permitting primer 330 to be driven forward. When primer 330 is driven forward, the portion of primer composition (now consumed) that was contained in pinch point 390 formed by the close proximity of impact face 332 of primer 330, and primer anvil 342 of support sleeve 340 is crushed. The crushing of primer composition 380 within pinch point 390 initiates deflagration of priming composition 380. Deflagration of priming composition 380 in primer cavity 334 produces flame 300 that enters the propellant 318, causing the propellant to ignite. Ignition of the propellant causes the pressure in primer cavity 334 to rapidly increase beyond the hoop strength of the wall of primer cavity 334, causing the wall of primer cavity 334 to expand against the interior of support sleeve 340, forming a tight pressure-actuated seal between the front of primer 330 and the inside of support sleeve 340.

Figure 12:
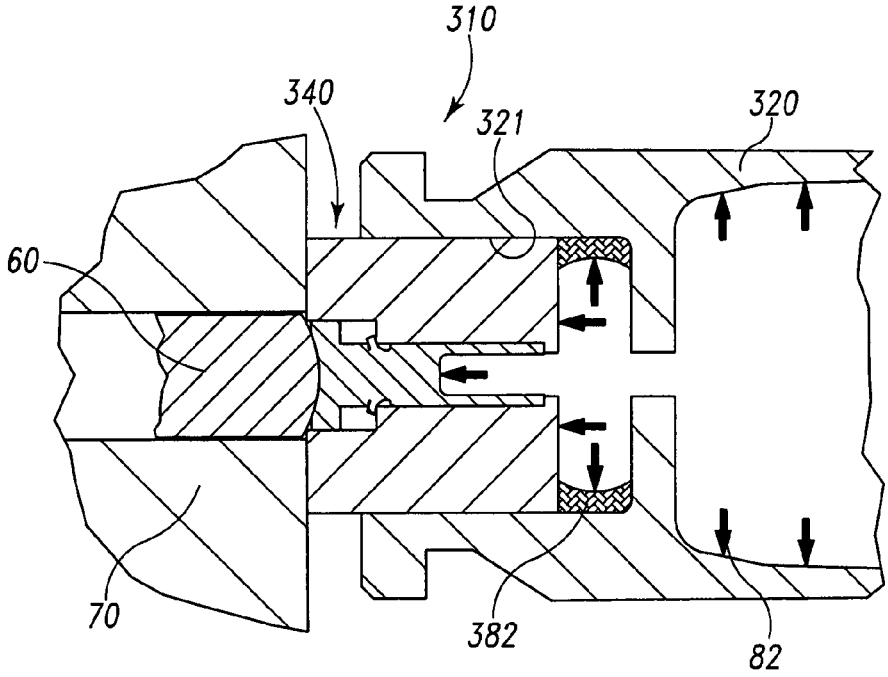
FIG. 12 is a sectional side view of the embodiment of FIG. 9 during the power stroke.

As shown in FIG. 12, the pressure of the propellant gas also acts upon seal 382 to displace seal 382 radially outwardly from passage 348. Seal 382 can be made from a highly viscous fluid, such as asphalt that is commonly used in the manufacture of cartridges to prevent entrance of water and other contaminants. Seal 382 can also be made from any suitable plastic or elastic material. Seal 382 is located in a space between the forward end of support sleeve 340 an inner wall 324 of cartridge case 320 that separates the rearward recess of cartridge case 320 from the propellant cavity. Wall 324 includes a hole 326 to permit ignition of the propellant by the priming composition. Pressure inside cartridge 310 presses seal 382 into intimate contact with the forward end of support sleeve 340 and the inner wall surface of cartridge case 320 around support sleeve 340, preventing leakage of propellant gas between support sleeve 340 and cartridge case 320.

If the cartridge is being fired in a delayed-extraction firing mechanism, then while the propellant gases are driving the projectile forward, the propellant gases are also driving the support sleeve and weapon bolt rearward. In addition, the propellant gases press the cartridge case body outwardly against the chamber wall of the barrel. The cartridge case remains stationary while the projectile and bolt are being accelerated in opposite directions. When the pressure subsides sufficiently for the cartridge case to elastically relax away from the chamber wall, the extractor removes the cartridge case from the chamber for ejection. A plenum 360, formed by the space between support sleeve 340 and primer head 331, provides a volume in which to disperse and collect any propellant gas that might escape between the interior of support sleeve 340 and primer 330. In addition to guarding against accidental firing, shoulder 336 also acts as a further seal to trap gas that may escape along the side of primer 330.

Refer now to FIG. 12, support sleeve 340 is illustrated nearing the end of the power stroke. Pressure inside cartridge case 320 is represented by small arrows 82 that show radial pressure as well as longitudinal pressure. Once radial pressure has sufficiently subsided to permit cartridge case 320 to elastically contract away from the chamber then the delayed extractor (not shown) of bolt 70 will extract cartridge case 320 from the chamber.

In the embodiment discussed above, there is provided a cartridge case with the primer 330 having primer cavity 334 that is thin walled and weak enough to permit the front of the primer to expand very tightly to seal the primer with the support sleeve 340.

There is also provided a cartridge case with shoulder 336 that serves to prevent the primer 330 from accidentally being driven forward to set off the priming composition. The shoulder is flanked by grooves 338 to let the shoulder be plastically deformed, rather than being sheared, although sheared is not precluded. In addition, a cartridge case with pinch point 390, as controlled by the location of the shoulder 336, is a very convenient way to place the priming composition in a very thin layer, which is desirable in some embodiments.

For any of the embodiments discussed herein, a firearm and firearm cartridge can be provided with a bolt. The bolt is provided with a longitudinally moveable extractor. The longitudinally moveable extractor is provided a spring that urges the longitudinally moveable extractor. The firearm cartridge can be provided with a primer pocket that receives a slideably moveable primer supporting sleeve. The slideably moveable supporting sleeve supports a primer in the primer pocket.

While multiple embodiments have been illustrated and described in detail in the drawings and foregoing description, the same is to be considered illustrative and not restrictive in character, it being understood that only selected embodiments have been shown and described and that all changes, equivalents, and modifications as would occur to those skilled in the art and that come within the scope of the inventions described herein or defined by the following claims are desired to be protected. Any experiments, experimental examples, or experimental results provided herein are intended to be illustrative of the present inventions and should not be construed to limit or restrict the scope of the present application. Further, any theory, mechanism of operation, proof, or finding stated herein is meant to further enhance understanding of the present application and is not intended to limit the inventions described herein in any way to such theory, mechanism of operation, proof, or finding. In addition, the various procedures, techniques, and operations may be altered, rearranged, substituted, deleted, duplicated, or combined as would occur to those skilled in the art. Further, any U.S. patent, pending U.S. Patent Application Publication or other publication cited herein is incorporated herein by reference in its entirety as if each individual publication, patent, or patent application was specifically and individually indicated to be incorporated by reference and set forth in its entirety herein. In reading the claims, words such as the word "a," the word "an," the words "at least one," and the words "at least a portion" are not intended to limit the claims to only one item unless specifically stated to the contrary. Further, when the language "at least a portion" and/or "a portion" is used, the claims may include a portion and/or the entire item unless specifically stated to the contrary.

Any reference to a specific direction, for example, references to up, upper, down, lower, and the like, is to be understood for illustrative purposes only or to better identify or distinguish various components from one another. Unless specifically identified to the contrary, all terms used herein are used to include their normal and customary terminology. Further, while various embodiments of devices having specific components and structures are described and illustrated herein, it is to be understood that any selected embodiment can include one or more of the specific components and/or structures described for another embodiment where possible.

What is claimed is:

1. A cartridge for a firearm, comprising:

a cartridge case and a propellant contained in said cartridge case, said cartridge case further defining a recess extending forwardly from a rearward end of said case to an end wall adjacent to said propellant;

a projectile at a forward end of said cartridge case;

a primer support member in said recess adjacent said rearward end of said cartridge case, said primer support member including a pocket extending therein that opens at a forward end of said primer support member, said primer support member further including a flange extending around said pocket at said forward end of said primer support member and a groove in an outer surface of said primer support member rearwardly of said flange, said groove permitting propellant gases generated upon firing said cartridge to seal said flange of said primer support member against said cartridge case while said groove is located in said recess to collect any propellant gases passing through said seal between said primer support member and said cartridge case; and a primer in said pocket for holding priming composition between said primer support member and said propellant.

2. The cartridge of claim 1, wherein said groove is annular and extends completely around said primer support member.

3. The cartridge of claim 1, wherein said primer support member includes a central passage extending from a rearward end of said primer support member to said pocket of said primer support member.

4. The cartridge of claim 1, wherein said primer support member is frictionally engaged with said cartridge case in said recess, and further comprising a lubricant between said cartridge case and said primer support member facilitating sliding movement of said primer support member relative to said cartridge case.

5. The cartridge of claim 1, wherein said cartridge case includes an extraction rim at a rearward end thereof for engagement by an extractor of the firearm.

6. The cartridge of claim 1, wherein during firing of the cartridge said flange of said primer support member radially expands to form said seal with said cartridge case in said recess of said cartridge case while said primer support member slides rearwardly in said recess of said cartridge case.

7. The cartridge of claim 1, wherein said forward end of said primer support member includes a beveled edge extending from said forward end to said pocket.

8. A cartridge for a firearm, comprising:

a cartridge case and a propellant contained in said cartridge case, said cartridge case further defining a recess extending forwardly from a rearward end of said case to an end wall adjacent to said propellant;

a projectile at a forward end of said cartridge case;

a primer support member in said recess adjacent said rearward end of said cartridge case, said primer support member including a pocket extending therein that opens at a rearward end of said primer support member, said primer support member further including a passage extending from said pocket through a forward end of said primer support member, said passage defining an anvil adjacent to said forward end of said primer support member and said primer support member includes a support surface in said pocket around said passage;

a primer in said passage of said primer support member, said primer including a forward end adjacent said anvil and a body extending to a primer head opposite said forward end that is located in said pocket of said primer support member, said primer further including a shoulder that extends outwardly from said body and is positioned adjacent to said support surface in said pocket to form a plenum in said pocket between said primer head and said shoulder; and priming composition between said forward end of said primer and said anvil.

9. The cartridge of claim 8, wherein said primer support member includes a groove extending around an outer surface thereof adjacent to said forward end of said primer support member.

10. A cartridge for a firearm, comprising:

a cartridge case and a propellant contained in said cartridge case, said cartridge case further defining a recess extending forwardly from a rearward end of said case to an end wall adjacent to said propellant;

a projectile at a forward end of said cartridge case;

a primer support member in said recess adjacent said rearward end of said cartridge case, said primer support member including a pocket extending therein that opens at a rearward end of said primer support member, said primer support member further including a passage extending from said pocket through a forward end of said primer support member, said passage defining an anvil adjacent to said forward end of said primer support member and said primer support member includes a support surface in said pocket around said passage;

a primer in said passage of said primer support member, said primer including a forward end adjacent said anvil and a body extending to a shoulder that extends outwardly from said body and is positioned adjacent to said support surface in said pocket; and priming composition between said forward end of said primer and said anvil, wherein said primer support member includes a groove extending around an outer surface thereof adjacent to said forward end of said primer support member and said cartridge case includes a cannelure thereon to press material of said cartridge case into said groove.

11. A cartridge for a firearm, comprising:

a cartridge case and a propellant contained in said cartridge case, said cartridge case further defining a recess extending forwardly from a rearward end of said case to an end wall adjacent to said propellant;

a projectile at a forward end of said cartridge case;

a primer support member in said recess adjacent said rearward end of said cartridge case, said primer support member including a pocket extending therein that opens at a rearward end of said primer support member, said primer support member further including a passage extending from said pocket through a forward end of said primer support member, said passage defining an anvil adjacent to said forward end of said primer support member and said primer support member includes a support surface in said pocket around said passage;

a primer in said passage of said primer support member, said primer including a forward end adjacent said anvil and a body extending to a shoulder that extends outwardly from said body and is positioned adjacent to said support surface in said pocket; and priming composition between said forward end of said primer and said anvil, wherein said body of said primer includes grooves in an outer surface thereof extending around opposite sides of said shoulder.

12. The cartridge of claim 11, wherein said body of said primer includes a primer cavity extending therein that opens at said forward end of said primer and said priming composition is in said cavity.

13. The cartridge of claim 12, wherein said primer includes a head at a rearward end thereof positioned in said pocket of said primer support member, said head and said primer support member forming a plenum in said pocket.

14. The cartridge of claim 12, wherein said wall of said body around said primer cavity radially expands upon firing of the cartridge to form a seal with said primer support member in said passage.

15. A cartridge for a firearm, comprising:

a cartridge case and a propellant contained in said cartridge case, said cartridge case further defining a recess extending forwardly from a rearward end of said case to an end wall adjacent to said propellant;

a projectile at a forward end of said cartridge case;

a primer support member in said recess adjacent said rearward end of said cartridge case, said primer support member including a pocket extending therein that opens at a rearward end of said primer support member, said primer support member further including a passage extending from said pocket through a forward end of said primer support member, said passage defining an anvil adjacent to said forward end of said primer support member and said primer support member includes a support surface in said pocket around said passage;

a primer in said passage of said primer support member, said primer including a forward end adjacent said anvil and a body extending to a shoulder that extends outwardly from said body and is positioned adjacent to said support surface in said pocket; and priming composition between said forward end of said primer and said anvil, wherein said shoulder is deformable against said support surface when a rearward end of said primer is struck with a firing pin.

16. A cartridge for a firearm, comprising:

a cartridge case and a propellant contained in said cartridge case, said cartridge case further defining a recess extending forwardly from a rearward end of said case to an end wall adjacent to said propellant;

a projectile at a forward end of said cartridge case;

a primer support member in said recess adjacent said rearward end of said cartridge case, said primer support member including a pocket extending therein that opens at a rearward end of said primer support member, said primer support member further including a passage extending from said pocket through a forward end of said primer support member, said passage defining an anvil adjacent to said forward end of said primer support member and said primer support member includes a support surface in said pocket around said passage;

a primer in said passage of said primer support member, said primer including a forward end adjacent said anvil and a body extending to a shoulder that extends outwardly from said body and is positioned adjacent to said support surface in said pocket; and priming composition between said forward end of said primer and said anvil, wherein said primer support member and said cartridge case form a space at a forward end of said primer support member and further comprising a seal in said space around said passage of said primer support member.

17. The cartridge of claim 16, wherein gas pressure from firing the cartridge displaces said seal outwardly in said space in intimate contact with said forward end of said primer support member and an inner surface of said cartridge case extending around said primer support member.

18. The cartridge of claim 17, wherein said seal comprises a viscous fluid.

19. A cartridge for a firearm, comprising:

a cartridge case and a propellant contained in said cartridge case, said cartridge case further defining a recess extending forwardly from a rearward end of said case to an end wall adjacent to said propellant;

a projectile at a forward end of said cartridge case;

a primer support member in said recess adjacent said rearward end of said cartridge case, said primer support member including a pocket extending therein that opens at a rearward end of said primer support member, said primer support member further including a passage extending from said pocket through a forward end of said primer support member, said passage defining an anvil adjacent to said forward end of said primer support member and said primer support member includes a support surface in said pocket around said passage;

a primer in said passage of said primer support member, said primer including an elongate body with a forward end adjacent to said anvil, a cavity extending into said body from said forward end, and a shoulder extending outwardly from said body positioned adjacent to said support surface in said pocket, wherein said body includes a wall extending around said cavity that is deformable when the cartridge is fired to sealingly engage said forward end of said primer in said passage of said primer support member; and priming composition in said cavity of said primer and between said forward end of said primer and said anvil.

20. The cartridge of claim 19, wherein said primer support member forms a space between said forward end thereof and said end wall of said cartridge case, and further comprising a seal in said space that seals said forward end of said support member and an inner surface of said cartridge case extending around said support member.

* * * * *